United States Patent [19]

Theurer et al.

[11] 4,236,452

[45] Dec. 2, 1980

[54] MOBILE APPARATUS FOR CONTINUOUSLY RENEWING TRACK

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Australia

[21] Appl. No.: 37,101

[22] Filed: May 8, 1979

[30] Foreign Application Priority Data

Jun. 28, 1978 [AT] Austria ..... 4714/78

[51] Int. Cl.[3] ..... E01B 29/02; E01B 27/11; E01B 29/05

[52] U.S. Cl. ..... 104/2; 104/6; 37/104; 171/16

[58] Field of Search ..... 104/2, 6, 7 R, 8; 37/104; 171/16

[56] References Cited

U.S. PATENT DOCUMENTS

| | | | |
|---|---|---|---|
| 2,914,817 | 12/1959 | Scheuchzer et al. | 37/104 |
| 3,654,868 | 4/1972 | Plasser et al. | 104/2 |
| 3,685,456 | 8/1972 | Plasser et al. | 104/2 |
| 3,699,894 | 10/1972 | Plasser et al. | 104/2 |
| 3,807,310 | 4/1974 | Plasser et al. | 104/2 |
| 4,046,077 | 9/1977 | Theurer et al. | 104/2 |
| 4,080,903 | 3/1978 | Sain | 104/6 |
| 4,094,249 | 6/1978 | Theurer | 104/2 |

FOREIGN PATENT DOCUMENTS

| | | | |
|---|---|---|---|
| 2612536 | 10/1976 | Fed. Rep. of Germany | 104/2 |
| 971803 | 10/1964 | United Kingdom | 104/2 |
| 1339842 | 12/1973 | United Kingdom | 104/2 |

*Primary Examiner*—Richard A. Bertsch
*Attorney, Agent, or Firm*—Kurt Kelman

[57] ABSTRACT

A track renewal train includes a semi-trailer work car which carries track renewal equipment and includes two selectively usable undercarriages for supporting the rear end of the work car. One of the undercarriages is an off-track track-laying bogie supporting the work car on the trackless section where track renewal is effected and the other undercarriage is a vertically movable on-track bogie. A selectively usable on-track bogie supports the forward end of the work car when it is linked thereto, the forward work car end being linked to the last car of the train during track renewal operations.

7 Claims, 2 Drawing Figures

MOBILE APPARATUS FOR CONTINUOUSLY RENEWING TRACK

Figure 1:
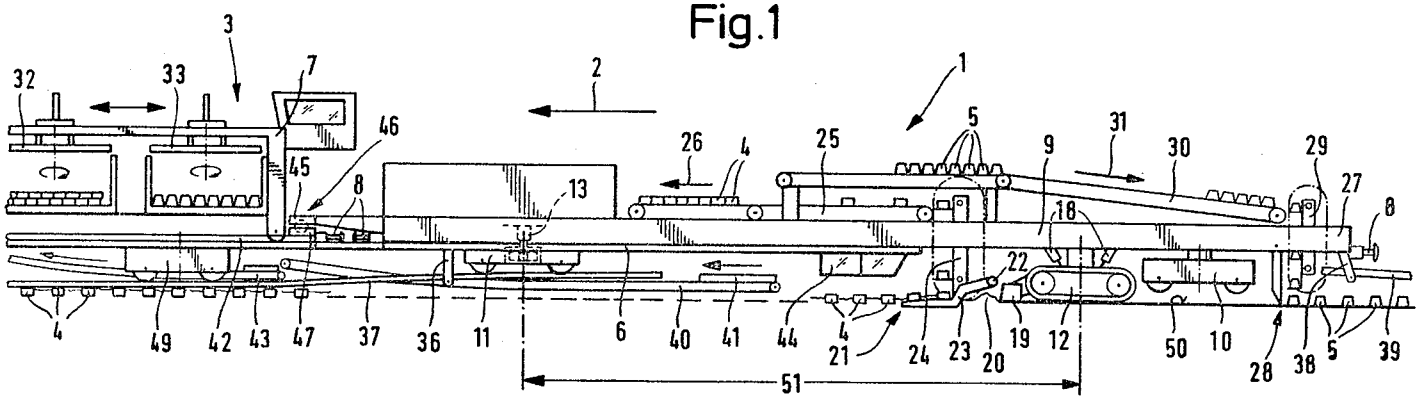

The present invention relates to improvements in mobile apparatus for continuously replacing old rails and ties of an existing railroad track by new rails and ties. More particularly, it relates to the type of track renewal apparatus comprising a train of cars mounted for mobility on the existing track and including cars for transporting the old and new ties, and a work car having a forward end and a rear end, the forward end of the work car being arranged adjacent a last one of the train cars and the work car carrying equipment adapted to work in a trackless section adjacent the track from which the rails and ties have been removed, the work car equipment including means for removing the old ties, means for laying the new ties, means for smoothing ballast between the tie removing and laying means, and guide means for raising and spreading apart the old rails.

British Pat. No. 1,339,842, published Dec. 5, 1973, discloses a track renewal train wherein this equipment is carried by a girder whose ends are linked to train cars respectively preceding and following the girder. This arrangement is designed to assure a substantially tangential positioning of the girder with respect to the right-of-way in curves but it has serious disadvantages. Since the girder ends are pivoted to on-track cars, one of which runs on the old track while the other one runs on the newly laid track, operating conditions require such a great distance between the rear and front undercarriages, respectively of the on-track cars that the pivotally supported girder cannot have the rigidity and stability required for trouble-free and accurate track renewal work. Furthermore, the rear train cars occupy track sections interfering possibly with train traffic, particularly in branch lines and in rail yards.

In contrast to this arrangement and improving thereon, U.S. Pat. No. 3,807,310, dated Apr. 30, 1974, discloses an elongated carrier frame for the work equipment bridging the trackless section and having its ends supported on swivel trucks. This imparts considerable rigidity and stability to the machine and since the work equipment is mounted transversely adjustable, the new track is accurately laid even in tight track curves.

In U.S. Pat. No. 3,685,456, dated Aug. 22, 1972, some of the track renewal equipment is carried by support arms having one end pivotally supported on respective cars of the renewal train while their other ends extend towards the trackless renewal section intermediate these train cars and may be selectively supported on vertically retractable on-track bogies.

In our U.S. Pat. No. 4,046,077, dated Sept. 6, 1977, we disclose a track renewal train with equipment for removing track sections of existing track and laying new ties and rails mounted on a work car at the rear of the train and extending over the trackless section. The forward end of the work car is supported on an on-track bogie running on the existing track and the rear work car end is supported on a track-laying off-track bogie running on the trackless section. This makes it possible, if desired, to uncouple any number of train cars without interrupting the track renewal operation after such train cars are loaded with old track sections and to couple other cars storing new train sections to the train in their stead. In this manner, long stretches of track may be renewed without interruptions and the down-time is correspondingly reduced so as to minimize interference with train traffic. In addition, since the work car is the last one of the train, no further track sections therebehind are occupied.

British Pat. No. 971,803, published Oct. 7, 1964, discloses mobile track laying and removing apparatus wherein cantilever arms have one end pivotally supported on a train car while their free ends have rail grippers for lifting the rails while a mechanism for removing the ties is mounted on the cantilever arms intermediate their ends.

German published Patent Application No. 2,612,536, published Oct. 14, 1976, deals with a ballast cleaning machine wherein one end of a support frame for the ballast excavating chain and the ballast cleaning screen is affixed to a front car running on the track while its other end is supported on an on-track rear car.

In our copending patent application Ser. No. 845,388, filed Nov. 25, 1977, now U.S. Pat. No. 4,152,989, we have disclosed a mobile apparatus for replacing old rails and ties by new rails and ties of the first-indicated type, wherein the work car runs on the existing track on an on-track bogie while the rear end of the work car may be supported on the trackless section on a track-laying off-track bogie. The ballast is smoothed by a ballast excavating arrangement whose transverse excavating chain portion is positioned immediately ahead of the off-track bogie. The means for laying the new ties, the ballast redistributing means and the retractable on-track bogie for the rear end of the work car are arranged sequentially behind the off-track bogie. The lowering of the new rails onto the newly laid ties is effected behind the track renewal train. The simple structure, the economy and the efficiency of this machine have made it very successful in commercial track renewal operations.

It is the primary object of this invention to improve on this type of apparatus by making the work car more compact in the direction of track elongation and to provide a functionally and structurally more favorable arrangement of the operating equipment and of its support bogies. Furthermore, it is an object of the invention to provide a work car capable of meeting all requirements of standard railroad cars for high-speed movement between working sites.

The above and other objects are accomplished in an unexpectedly simple manner with a work car which is a semi-trailer and includes two selectively usuable undercarriages for supporting the rear end of the work car, one of the undercarriages being an off-track track laying bogie supporting the work car on the trackless track section and the other undercarriage being a vertically movable on-track bogie. A selectively usable undercarriage supports the forward end of the work car, the forward undercarriage being a vertically movable on-track bogie. The forward end of the work car is selectively linked to the last train car or to the forward undercarriage for support of the forward work car end.

With this arrangement, it is possible to link the forward end of the work car to its own on-track bogie when the work car is transferred between working sites while, during operating, the forward work car end is linked to the rear end of the preceding train car. In this manner, even if the work car is much shorter than in previous arrangements, the distance between its front support, which is the rear undercarriage of the preceding train car, and the rear support, which is the off-track bogie, is sufficient so that the old rails being taken up and the new rails being laid are not unduly bent in their paths. Shortening of the work car, on the other hand, results not only in considerable savings in material and reduction in weight but also to an increased rigidity and stability of the work car frame, which in turn produces a more accurate operation of the operating equipment mounted on the work car frame and a high accuracy in the positioning of the new track. Furthermore, such a work car will be able to move at high speeds on open track, either as part of a train or on its own power.

Figure 2:
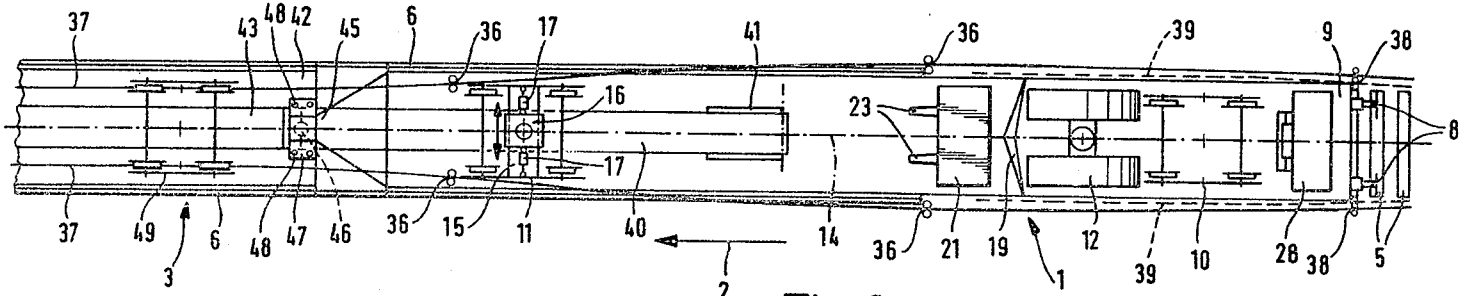

The above and other objects, advantages and features of the present invention will become more apparent from the following detailed description of a now preferred embodiment thereof, taken in conjunction with the accompanying schematic drawing wherein FIG. 1 is a side elevational view of a mobile apparatus for continuously replacing old rails and ties by new rails and ties, showing the work car and the rear portion of the preceding train car; and FIG. 2 is a top view of FIG. 1.

Referring now to the drawing, the illustrated mobile apparatus is shown to form part of a track renewal train of cars for transporting old ties 4 and new ties 5, as well as other track components in a manner more fully described and illustrated in the above-mentioned patents. Only the rear portion of the last train car 3 is shown, the train advancing during the track renewal operation in an operating direction indicated by arrow 2, car 3 being followed by work car 1. In a well known manner forming no part of this invention, some of the train cars carry equipment for removing rail fastening elements from the old track, and the train cars also carry a guide track for moving a gantry crane 7 along the entire length of the train for transporting ties from and to work car 1.

Work car 1 is a semi-trailer comprising bridge-like elongated carrier frame 9 and including two selectively usable undercarriages for supporting the rear end of the work car and a selectively usable undercarriage for supporting the forward end of the work car. One of the undercarriages for supporting the rear work car end is off-track track-laying bogie 12 supporting work car 1 on the trackless track section bridged by the work car carrier frame, and the other undercarriage for supporting the rear work car end is a vertically movable on-track bogie 10. During a track renewal operation, on-track bogie 10 is retracted. When the work car moves on track as it travels from one working site to another, bogie 10 is lowered into engagement with the track. The undercarriage supporting the working car front end selectively is also a vertically movable on-track bogie retracted and lowered in the same manner and at the same time as bogie 10. In addition to being vertically movable, front bogie 11 is also transversely movable to the work car in relation thereto, as schematically indicated in FIG. 2 by a double-headed arrow, transverse guides for supporting undercarriage for such transverse movement being well known. Hydraulic motor 13 connects undercarriage 11 to carrier frame 9 for vertical movement while hydraulic motors 17 connect part 16 of cradle 15 of the undercarriage to the carrier frame for transverse movement of the undercarriage in relation to track axis 14. Hydraulic motor 13 is also connected to undercarriage part 16. Hydraulic motor 18 connects off-track bogie 12 with carrier frame 9 and actuation of this motor raises or lowers the entire rear end of the work car, including undercarriage 10.

Work car 1 carries equipment adapted to work in a trackless section adjacent the track from which the rails and ties have been removed and this equipment includes means 21 for removing old ties 4, means 28 for laying new ties 5 and means 19 for smoothing ballast between the tie removing and laying means. The schematically illustrated ballast smoothing means 19 is a planing and compacting apparatus mounted adjustably on bogie 12 for smoothing and, if desired, shaping ballast 20. Tie removing means 21 includes tie engaging elements 23 pivotal about transverse pivot axis 23 for delivering old ties 4 sequentially to elevator 24 which moves the ties sequentially to conveyor 25 mounted on carrier frame 9 in the direction of arrow 26. Tie laying means 28 is mounted immediately rearwardly of bogie 10 and receives new ties 5 from elongated conveyor 30 in an operating direction indicated by arrow 31, tie laying means 28 including elevator 29 lowering the new ties from conveyor 30 to the smoothed ballast.

As shown, means 46 is provided at forward end 45 of work car carrier frame 9 for selectively linking this forward end to last train car 3 when the work car is in operation.

For operation in curves, the transverse movability of forward undercarriage 11 has the advantage of ready adaptation to the curve so that this undercarriage may be readily engaged with and disengaged from the track even in tight curves. The on-track bogies are illustrated as swivel trucks with a standard railroad car wheel base so that the work car may be readily used as part of a train without any further structural adaptation. The closely spaced arrangement of off-track bogie 12 and on-track bogie 10 between tie removing means 21 and tie laying means 28 at the rear of work car 1 is very space-efficient and is also advantageous with respect to the selective use of these rear bogies.

As can be seen in the drawing, new tie conveyor 30 extends forwardly about to the middle of old tie conveyor 25 so that gantry crane 7 can be moved into a position where it is enabled to pick up one or more layers of old ties 4 from conveyor 25 and simultaneously to deliver one or more layers of new ties 5 to conveyor 30, with its tie engaging and carrying mechanisms 32 and 33. To make it possible to store the ties on the train cars in a position parallel to track axis 14, tie carrying mechanism 32 and 33 may be turned about respective vertical axes, as indicated by arrows.

The equipment on the work car further comprises guide means 36 constituted by guide rollers at both sides of carrier frame 9 for raising and spreading apart old rails 37 after they have been detached from old ties 4 by removing the rail fastening elements. Furthermore, the equipment also comprises means 38 at rear end 27 of the work car for lowering new rails 39 onto newly-laid ties 5, rail lowering means 38 being arranged rearwardly of swivel truck 10. Rail guide means 38 serve also for laying old rails 37 along the shoulders of the new track.

All of the above described track renewal operating equipment is conventional and the specific structure of such equipment forms no part of this invention.

According to a preferred embodiment of the invention, work car 1 comprises elongated conveyor 40 for transporting tie plates detached from old ties 4 in a path extending from inlet end 41 of the conveyor arranged forwardly of means 21 for removing the old ties, under and passed forward bogie 11 to rear end 42 of last train car 3. Another elongated conveyor 43 is arranged on car 3 to receive the tie plates from conveyor 40. The rear end of the last car is supported on the existing track on rear undercarriage 49 and conveyor 43 is supported on last train car 3 for transporting the ties plates in a path extending under and passed rear undercarriage 49. Conveyor 43 has a delivery end (not shown) adjacent a storage receptacle for the tie plates. An operator's cab 44 is mounted on the underside of carrier frame 9 so that inlet end 41 of conveyor 40 and old tie removing means 21 are within the range of vision of an operator in the cab. This arrangement is very functional and also makes a full control of the removal of all rail fastening elements readily possible.

As shown in the drawing, forward end 45 and rear end 27 of work car 1 carry couplings 8 enabling the work car to be integrated in a train of cars and, more particularly, to couple the work car to train car 3. Work car forward end 45 forms the upper part of two-part bearing socket 46 for linking the forward end of the work car to rear end 42 of last train car 3, this upper part of the bearing socket projecting over coupling 8 and cooperating with lower bearing socket part 47 on rear end 42 for pivotally coupling the work car to the last train car. Lower bearing socket part 47 is detachably mounted on car rear end 42, for instance by screws 48. This linkage of the semi-trailer work car to the last train car is structurally very simple and has the further advantage that existing track renewal trains may be readily equipped with such a selectively usable attachment. The lower bearing socket part may be readily detached and attached at the end and the beginning of the renewal operations.

In the illustrated operating position during track renewal, work car 1 is respectively supported via bearing socket 46 on rear undercarriage 49 of last train car 3 and on off-track bogie 12 moving in the trackless section where track renewal takes place and which carrier frame 9 of the work car bridges. In this position, on-track bogie 10 and 11 are raised off the ground. This displacement of the forward support of work car 1 from forward bogie 11 to rear undercarriage 49 of the preceding car enables old rails 37 to be raised immediately behind undercarriage 49 and to be spread to a lateral distance required for passage of the old rails through the work zone without interfering with the work. This, on the other hand, makes it possible to move the equipment for picking up the old ties, smoothing the ballast bed, laying the new ties and lowering the new rails closer to undercarriage 49 by a distance corresponding to that between undercarriage 49 and bogie 11. Wheel base 51 of the work car can, therefore, be shortened accordingly, for instance to a length of 15 m.

After the track renewal operation has been completed, on-track bogies 10 and 11 are lowered into engagement with the newly laid track and bogie 11 is laterally aligned with the track by operation of motors 17 with respect to track axis 14 in a track curve. Off-track bogie 12 and the ballast engaging elements of tie removing means 21 and tie laying means 28 are raised, bearing socket part 47 is detached, and cars 1 and 3 are coupled together by coupling 8 to ready the work car for removal from the working site as part of the train.

Many variations and modifications will occur to those skilled in the art, particularly with respect to the operating equipment. Also, the apparatus is not limited to use with track renewal trains for replacement of an entire existing track by a new track but may also be used merely for removing rails and ties of an existing track without being replaced by a new track or where a new track is laid by other apparatus. In this case, the apparatus will leave and effectively smoothed and compacted ballast bed which may then serve as support for a new track.

What is claimed is:

1. A mobile apparatus for continuously replacing old rails and ties of an existing railroad track by new rail and ties, which comprises a train of cars mounted for mobility on the existing track and including cars for transporting the old and new ties, and a work car having a forward end and a rear end, the forward end of the work car being arranged adjacent a last one of the train cars and the work car carrying equipment adapted to work in a trackless section adjacent the track from which the rails and ties have been removed, the work car equipment including means for removing the old ties, means for laying the new ties, means for smoothing ballast between the tie removing and laying means, and guide means for raising and spreading apart the old rails, the work car being a semi-trailer and including two selectively usable undercarriages for supporting the rear end of the work car, one of the undercarriages being an off-track track-laying bogie supporting the work car on the trackless track section and the other undercarriage being a vertically movable on-track bogie, and a selectively usable undercarriage for supporting the forward end of the work car, the forward undercarriage being a vertically movable on-track bogie, and means for selectively linking the forward end of the work car to the last train car or to the forward undercarriage for support of the forward work car end.

2. The mobile apparatus of claim 1, further comprising a two-part bearing socket for linking the forward end of the work car to a rear end of the last train car, a lower part of the bearing socket being detachably mounted on the rear end of the last car and an upper part of the bearing socket projecting from the forward end of the work car and cooperating with the lower bearing socket part for pivotally coupling the work car to the last train car.

3. The mobile apparatus of claim 2, further comprising a coupling between the last train car and the work car, the upper bearing socket part projecting above the coupling.

4. The mobile apparatus of claim 1, wherein the forward undercarriage is movable transversely to the work car in relation thereto.

5. The mobile apparatus of claim 1, wherein the on-track bogies are swivel trucks with a standard railroad car wheel base.

6. The mobile apparatus of claim 5, wherein the equipment on the work car comprises means for lowering the new rails onto the newly-laid ties, the means for laying the new ties being arranged rearwardly of the swivel truck supporting the rear end of the work car.

7. The mobile apparatus of claim 1, wherein the equipment on the work car comprises an elongated conveyor for transporting tie plates detached from the old ties in a path extending from an inlet end of the conveyor arranged forwardly of the means for removing the old ties, under and passed the forward bogie to the rear end of the last train car, and further comprising another elongated conveyor arranged to receive the tie plates from the first-mentioned conveyor, the last train car being supported on the existing railroad track on a rear undercarriage, and the other elongated conveyor being supported on the last train car for transporting the tie plates in a path extending under and passed the rear undercarriage.

* * * * *